US006854450B2

(12) United States Patent
Kitagawa et al.

(10) Patent No.: US 6,854,450 B2
(45) Date of Patent: Feb. 15, 2005

(54) ELECTRONIC CONTROL SYSTEM FOR ENGINE

(75) Inventors: Yuichi Kitagawa, Numazu (JP); Kazuyoshi Kishibata, Numazu (JP); Hiroyasu Sato, Namazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/637,157

(22) Filed: Aug. 8, 2003

(65) Prior Publication Data

US 2004/0050368 A1 Mar. 18, 2004

(30) Foreign Application Priority Data

Sep. 17, 2002 (JP) ..... 2002-269702
Jun. 9, 2003 (JP) ..... 2003-164082

(51) Int. Cl.[7] ..... F02D 4/06
(52) U.S. Cl. ..... 123/491; 123/179.16
(58) Field of Search ..... 123/491, 179.16, 123/179.18

(56) References Cited

U.S. PATENT DOCUMENTS 3,683,871 A * 8/1972 Barr et al. ..... 123/491
4,207,845 A * 6/1980 Semmler ..... 123/325
5,161,496 A * 11/1992 Matsushima et al. ..... 123/478
5,482,022 A * 1/1996 Aoki et al. ..... 123/491
5,937,829 A * 8/1999 Endou ..... 123/497
6,575,143 B2 * 6/2003 Uemura et al. ..... 123/491

FOREIGN PATENT DOCUMENTS

JP 3086335 7/2000

* cited by examiner

*Primary Examiner*—Erick Solis
(74) *Attorney, Agent, or Firm*—Pearne & Gordon LLP

(57) ABSTRACT

An electronic control system for an internal combustion engine comprising a controller having a fuel injection control section to control an injector of a fuel injection unit to supply fuel to the engine and an electric power source section to apply a driving power from a generator driven by the engine to the fuel injection unit and the controller, the controller having a first injection command generation section to generate an injection command when an output voltage of the generator reaches a set value whereby a first fuel injection at a start of the engine is made when the first fuel injection command generation section generates the injection command.

13 Claims, 6 Drawing Sheets t1 t2 t3 t4 t5 t6 t7 t8 t9
Ta
COM EXP EXH INT COM EXP EXH
Vs2
Vs1
Vs

Vj
Vj1
Vj2
Vj3

Vi
Vi1
Vi2

[V]
(10V)
Vb
Va
(9V)
Vo
(5V)
Vcc

FP

TIMEt t1
t2
t3
Ta
Vs2

Vs
Vs1

Vj
Vj1
Vj2
Vj3

Vi
Vi1
Vi2

Vph
Vph

Vb
(10V)
Vo
(5V)
Vcc
TIMEt

ELECTRONIC CONTROL SYSTEM FOR ENGINE

TECHNICAL FIELD OF THE INVENTION

This invention pertains to an electronic engine control system to control a fuel injection unit and an ignition unit using a microprocessor.

BACKGROUND OF THE INVENTION

An electronic engine control system has been widely used as a control system to control a fuel injection unit to supply fuel to an internal combustion engine using an injector (an electromagnetic fuel injection valve) or an ignition unit to ignite the engine.

The electronic engine control system comprises a controller having an ignition control section to control the ignition unit, a fuel injection control section to control the fuel injection unit, both of which are formed of a microprocessor and an electric supply source section to apply a driving power to the ignition unit, the fuel injection unit and the controller.

Of late, there have been used such an electronic engine control system for a vehicle engine of relatively small exhaust amount started by a starter such as a kicking starter or a recoil starter to be operated by a human power without any battery mounted thereon or a general-purpose engine.

In the vehicle having no battery mounted thereon, there is provided an electric power source section formed of an AC generator driven by the engine and a converter to convert an output voltage of the generator into a DC voltage to supply the driving power from the electric power source section to the ignition unit, the fuel injection unit and the controller.

The ignition control section comprises an ignition timing arithmetical operation part to arithmetically operate an ignition timing on control conditions such as a rotational speed and others and an ignition command generation part to generate an ignition command to be applied to the ignition unit when the ignition timing is detected by making a counting operation for detecting the arithmetically operated ignition timing by means of an ignition timer.

The fuel injection control section comprises: an injection amount decision section to decide a fundamental injection amount of fuel necessary for obtaining a mixture gas of predetermined air-to-fuel ratio for an intake air amount detected based on a throttle opening degree $\alpha$ of the engine (an opening degree of a throttle valve) and a rotational speed N thereof and to correct the fundamental injection amount of fuel in accordance with various control conditions such as an atmospheric pressure, an intake air temperature, a temperature of cooling water of the engine etc. to decide an actual injection amount; an injection command generation section to generate an injection command at predetermined injection timing; and an injector drive part to drive an injector in accordance with the injection command to make an injection of fuel. The amount of fuel injected from the injector is decided on a time during which the fuel is injected (an injection time) and a pressure of fuel which is applied from the fuel pump to the injector. In general, with the constant fuel pressure applied to the injector, the injector is driven for the injection time arithmetically operated for the fuel injection amount whereby the predetermined amount of fuel is injected from the injector.

In order to control the ignition timing and the injection amount of fuel of the engine, it is required to provide information of a crank angle and of a rotational speed of the engine to the controller. To this end, in the case where the ignition timing and the fuel injection amount of the engine are controlled by the electronic engine control system, there has been mounted on the engine a signal generation device to generate a pulse signal at a predetermined crank angle position of the engine whereby the crank angle information is obtained from each pulse signal generated by the signal generation device, and the rotational speed information of the engine is obtained from a generation interval of the pulses generated at the specific crank angle position by the signal generation device (or the time required for one revolution of a crankshaft of the engine).

There has been used as the signal generation device a pulser to generate first and second pulses having different polarities when there are detected a front edge and a rear edge of a rotational direction of a reluctor formed of a protrusion or a recess provided on or in an outer periphery of a flywheel of a flywheel magnet rotor mounted on the crankshaft of the engine.

The signal generation device may be so formed that the front edge of the reluctor is detected, at a timing suitable for a timing when a measurement of the ignition timing determined by the arithmetical operation starts and also suitable for a timing when the sequential injection of fuel is made, to generate a front edge pulse signal and that the rear edge of the reluctor is detected, at a timing suitable for the ignition timing when the engine starts and rotates at a low speed, to generate a rear edge detection pulse.

In the case where such a signal generation device is used, the ignition control section serves to make an ignition operation when the pulser detects the rear edge of the reluctor at starting the engine to generate the rear edge pulse, and also serves to make the ignition operation when the measurement of the ignition timing is completed, the measurement being started when the pulse generates the front edge pulse after the engine starts in a range where the rotational speed exceeds a set value.

Also, the fuel injection control section serves to drive the injector to make the sequential injection of fuel when the signal generation device generates the front edge detection pulse.

At least one revolution of the crankshaft will be required for obtaining the rotational speed information necessary for the arithmetical operation of the fuel injection amount after the initiation operation of the engine starts in the case where the aforementioned signal generation device is used, and furthermore, the fuel injection of proper amount corresponding to a cranking speed will not be able to be made until the arithmetical operation of the fuel injection amount based on the rotational speed information is completed.

With the battery mounted on the vehicle and so on driven by the engine, the crankshaft can be rotated by the starter motor until a proper amount of the fuel with which the rotational speed is reflected is injected when the engine starts, and therefore there is no trouble for starting the engine. However, in the case where the engine is started by a starter such as a kicking starter or a recoil starter operated by a human power, the crankshaft can be rotated just two or three times by cranking on the starting operation and therefore, the proper amount of fuel with which the rotational speed is reflected cannot be injected as described hereinafter, which deteriorates the startability of the engine.

FIGS. 6A through 6E are time charts to show the starting operation of a four cycle single cylinder engine which has no battery mounted thereon and is started by the kicking starter with the prior control system. FIG. 6A shows the front edge detection pulses Vs1 and the rear edge detection pulses Vs2 output by the pulser relative to time t, and FIG. 6B shows the injection command signals Vj. FIG. 6C shows the ignition command signals Vi, FIGS. 6D and 6E show the output voltage Vcc of the electric power source section having the generator used as the electric power source and the fuel pressure FP applied to the injector, respectively.

In FIG. 6A, "EXP" and "EXH" designate an expansion stroke and an exhaust stroke, respectively, while "INT" and "COM" designate an intake stroke and a compression stroke, respectively.

The electric power source section having the generator used as the electric power source section comprises a converter having a function to rectify the output of the generator and a function to regulate the voltage so that the rectified output never exceeds a regulation value, whereby the DC voltage Vcc, regulated so as not to exceed the regulation value Vr, is output as shown in FIG. 6D. The output of the electric power source section is applied to the fuel pump and the injector and also to a power source terminal of the microprocessor after reduced by a constant voltage electric power source circuit to a constant voltage (5V) suitable for driving the microprocessor. The output voltage Vcc of the electric power source section varies in the same manner as the output voltage of the generator until it reaches the regulation value Vr (about 16V in the illustrated embodiment) of the output voltage of the electric power source section. Thus, the variation in the output voltage Vcc of the electric power source section on the start of the engine can be regarded as that in the output voltage of the generator.

There appear depressions in a waveform of the output voltage Vcc of the electric power source section whenever the injection command signal or the ignition command signal is generated in the process in which the output voltage of the generator rises towards the regulation value Vr at the time of starting of the engine. In FIG. 6D, the depression a appearing in the waveform of the output voltage Vcc of the electric power source section corresponds to that of the electric power source voltage produced by the generation of the injection command Vj1, while the depression b of the same waveform corresponds to that of the electric power source voltage produced by the generation of the injection command Vj2. The depressions c and d in the waveform of the output voltage Vcc correspond to those of the electric power source voltage produced by the generation of the ignition command signal Vi1 and the injection command Vj3, respectively. The depression e corresponds to that of the electric power source voltage produced by the generation of the ignition command signal Vi2.

In the example shown in FIG. 6, after the starting operation begins and when the output voltage Vcc of the electric power source section reaches an initiation voltage Vo (5V, for instance) of the microprocessor, this microprocessor is initiated at time t1. Then, when the pulser generates the front edge detection pulse Vs1 at time t2, the injection command Vj2 is generated. The signal width of the injection command signal is determined on the sum of the injection time to determine the injection amount and a useless injection time (a time until it starts the injection of the fuel after the drive voltage is applied to the injector).

In FIG. 6, the injection command Vj1 is generated when the microprocessor is initiated at time t1, which will be described later. Herein, it is supposed that the injection command Vj1 is not generated.

Although the fuel injection time at time t2 may be determined by the arithmetical operation, the microprocessor, which the controller is formed of, arithmetically operates the fuel injection time using the rotational speed set when it is initialized because no practical rotational speed information is yet detected at time t2.

The injection command generated at time t2 is applied to an injector drive circuit. Thus, the injector drive circuit applies a drive voltage to the injector, but the output voltage of the generator still does not reach a valve openable voltage V1 at time t2, and the output voltage Vcc of the electric power source section also does not reach the valve openable voltage. Therefore, the injector cannot inject the fuel of injection amount arithmetically operated.

In general, when the engine stops, the piston cannot exceed a top dead center in the course of the compression stroke. Thus, in most cases, when the engine should start, the compression stroke and the expansion stroke are performed by the first revolution of the crankshaft, and the exhaust stroke and the intake stroke are performed by the second revolution. In the example of FIG. 6, the expansion stroke begins at time t3.

Accordingly, when the injection command Vj2 is generated at time t2, the engine is in the compression stroke (COM), and an intake valve is closed so that the injected fuel is never inhaled into the cylinder.

When the signal generation device generates the rear edge detection pulse Vs2 at time t3, the ignition command signal Vi1 is applied to the ignition circuit so that the ignition operation is performed, but since the fuel is not yet inhaled into the cylinder, the first explosion of the engine cannot occur.

At time t4, the output voltage of the generator reaches the valve openable voltage V1 that enables the injector to open the valve, at time t4 and the output voltage Vcc of the electric power source section also reaches the valve openable voltage, but since the time t4 is not the sequential injection timing, the injection command is never generated and no injection of fuel is performed even though the output voltage Vcc of the electric power source section reaches the valve openable voltage.

Since the pulser again generates the front edge detection pulse at time t5, the rotational speed is renewed. Since the injection command Vj3 is generated at time t5, the injector injects the fuel. The injection time at that time is already arithmetically operated before time t5. Thus, it will be noted that the injection at time t5 does not yet reflect the actual rotational speed, and therefore the injection of fuel with the amount suitable for the conditions of the engine is not performed.

When the pulser generates the rear edge detection pulse at time t6, the ignition operation is performed, but since this timing is one at which the exhaust stroke (EXH) terminates, no combustion occurs.

When the intake stroke begins at time t6, the fuel injected and evaporated into the intake pipe at time t2 and the fuel injected and evaporated into the intake pipe at time t5 are inhaled into the cylinder.

The fuel is injected on the injection command Vj4 at time t7 with the amount reflecting the rotational speed of the engine, but since the engine is in the compression stroke at time t7, the fuel injected on the injection command Vj4 is not yet inhaled into the cylinder.

When the pulser generates the rear edge detection pulse at time t8, the ignition operation is performed. As this ignites the mixture gases, the first explosion occurs and the engine starts.

In order to positively start the engine at time t8, the proper amount of fuel (the mixture gas of proper air-to-fuel ratio) should be inhaled in the intake stroke from time t6. The fuel to be inhaled into the cylinder in the intake stroke from time t6 is the one injected when the injection command Vj2 is generated at time t2 and the one injected when the injection command Vj3 is generated at time t5. However, the amount of fuel able to be injected when the injection command Vj2 is generated at time t2 tends to vary widely on the voltage Vcc and the fuel pressure FP at time 22. Even though the signal width of the injection command Vj3 is set at a proper value, there are some cases where the amount of fuel inhaled into the cylinder becomes improper according to the amount of fuel injected when the injection command Vj2 is generated. In addition thereto, since the signal width of the injection command Vj3 is the improper value, which does not reflect the rotational speed, in some cases, the fuel in the cylinder becomes insufficient or excessive at time t8 when the first explosion should be made and this prevents the positive ignition and deteriorates the startability of the engine.

As aforementioned, in order to positively start the engine at time t8, it is required that the fuel injection should be made so as to be able to inhale the fuel of proper amount, which reflects the rotational speed in the intake stroke from time t6. However, in the case where the engine is started by the starter such as the kicking starter or the recoil starter operated by the human power, the crankshaft can be rotated only two or three revolutions by cracking and therefore it is hard to inject the fuel of proper amount, which reflects the actual rotational speed when it should start.

In order to prevent the poor startability of the engine due to insufficient amount of fuel, it has been proposed to prevent the insufficient amount of fuel when the first explosion is performed by the first fuel injection during a predetermined time, which is made by the injection command Vj1 when the microprocessor initiates as described in Japan Patent No. 3086335. In the proposed invention, when the microprocessor initiates at time t1 of FIG. 6, the first predetermined injection time is set on the temperature of the cooling water of the engine so that there is generated the drive command Vj1 having the signal width corresponding to this predetermined injection time whereby the fuel injection is performed.

However, if the vehicle having no battery mounted thereon makes the first fuel injection on the initiation of the microprocessor, there occur the following problems.

Even if the injection command Vj1 is generated so as to inject the fuel during the predetermined time set in accordance with the temperature of the cooling water when the microprocessor is initiated at time t1 of FIG. 6, the voltage of the generator does not yet reach the valve openable voltage V1 (which is generally higher than the voltage necessary for initiating the microprocessor), and therefore the valve of the injector almost cannot be opened even if the injection command Vj1 is generated. Also, since the fuel pressure FP applied by the fuel pump is relatively lower, the fuel almost cannot be injected practically.

Because of the unstable useless injection time of the injector at times t1 and t2 when the output voltage of the generator does not reach the valve openable voltage, even if the valve of the injector could be opened, the fuel of the amount as determined by the arithmetical operation cannot be injected.

Although the output voltage of the generator exceeds the valve openable voltage V1 at time t5, the injection at time t5 reflects no actual rotational speed of the engine.

Although the fuel injection at time t7 reflects the actual rotational speed of the engine, the fuel injected at time t7 cannot be inhaled into the cylinder because the engine is in the compression stroke at time t7. Thus, the fuel injection at time t7 has the air-to-fuel ratio never reflected at time t8. In order to positively make the first explosion with the proper value of the air-to-fuel ratio of the mixture gas in the cylinder at the ignition at time t8, the fuel should be injected with the proper value reflecting the conditions of the engine before time t6 when the intake stroke begins.

On the start of the engine, the intake air amount varies due to the cranking speed. With the opening degree of the throttle kept constant, the higher the cranking speed is, the less the intake air amount is, and the lower the cranking speed is, the more the intake air amount is. However, in the prior fuel injection control, since the cranking speed is not considered when the injection time of the first fuel injection at the start is determined, the cranking speed becomes lower due to shortage of the operative force on the initiation operation and therefore the injection amount of the fuel is shorted when the intake air amount increases so that the air-to-fuel ratio becomes leaner whereby the startability of the engine is deteriorated.

Furthermore, since, in the prior control system, the ignition operation is made at time t3, which is the state where the enough amount of the fuel is not still injected, excessive electric power is consumed at the start, which disadvantageously causes the output voltage of the generator to become late to reach the valve openable voltage V1.

SUMMARY OF THE INVENTION

Accordingly, it is a principal object of the invention to provide an electronic engine control system adapted to improve the startability of the engine by making an effective first explosion as soon as possible after the initiation operation of the engine starts whereby an enough evaporation time can be maintained before the effective ignition operation is made.

It is another object of the invention to provide an electronic engine control system adapted to improve the startability of the engine by determining the injection amount of the fuel in consideration of the variation in the intake air amount based on the variation in the cranking speed at the start of the engine whereby the variation in the operative force on the initiation operation make less effect on the air-to-fuel ratio.

It is further object of the invention to provide an electronic engine control system adapted to make an effective first explosion at an early stage by preventing a useless ignition operation at the start of the engine so that the output voltage of the generator rises as soon as possible.

This invention is applied to an electronic engine control system comprising: a controller having an ignition control section to control an ignition of an internal combustion engine and a fuel injection control section to control an injector of a fuel injection unit to supply fuel to the engine; and an electric power source section to supply a driving power from a generator driven by the engine to the fuel injection unit and the controller. In the invention, the fuel injection control section comprises an injection amount decision section to decide a fuel injection amount, an injection command generation section to generate an injection command, an injector drive part to drive the injector in response to the injection command to inject the fuel from the injector whereby it generates a first injection command when an output voltage of the generator reaches a set value after the initiation operation of the engine starts.

The control system of the invention, a first timing at which the fuel can be injected from the injector as arithmetically operated in the state where after the start operation of the engine begins, a valve of the injector is positively opened and the useless injection time becomes generally constant is a timing when the output voltage of the generator reaches a valve openable voltage.

In this manner, with the first injection command for the start operation generated when the output voltage of the generator reaches the set value, the fuel can be injected at the shortest timing after the start operation begins by determining the set value so as to be equal to the valve openable voltage or the voltage slightly higher than the valve openable voltage. Thus, a time from the first fuel injection to an effective first ignition operation can be longer by performing the effective first injection at an earlier timing after the start operation of the engine begins whereby the injected fuel can be fully evaporated meanwhile. This enables an air-to-fuel ratio at the first ignition to become a proper value and therefore improves the startability of the engine.

In the preferred mode of the invention, the injection amount decision section comprises a first injection amount decision part to decide an injection amount for the first fuel injection at the start of the engine in accordance with a cranking speed of the engine.

The first injection amount decision part may be so constructed as to decide the first fuel injection amount by correcting the predetermined first fuel injection amount for the start of the engine in accordance with the cranking sped of the engine.

When the engine should start, the higher the cranking speed is, the less the intake air amount is, and the lower the cranking speed is, the more the intake air amount is. Thus, the first injection amount decision part is preferably so constructed as to decide an injection time (the injection amount) in accordance with the cranking speed so that the injection time becomes shorter as the cranking speed becomes higher while the former becomes longer as the latter becomes lower.

In this manner, with the first fuel injection amount for the start of the engine decided in accordance with the cranking speed of the engine, the variation in the intake air amount due to individual difference of the operative force for the start would hardly take an effect on the air-to-fuel ratio. Thus, the first effective ignition can be made in the state where the air-to-fuel ratio of the mixture gas in the cylinder always falls within the proper range in spite of the cranking speed whereby the startability of the engine can be improved.

A speculation of the cranking speed at the start of the engine may be made by providing in the injection amount decision section a cranking speed speculation part to speculate the cranking speed on an increase ratio of the output voltage of the generator.

In this manner, in the case where there is provided the cranking speed speculation part, the first injection amount decision part is so constructed as to decide the first injection amount using the cranking speed speculated by the cranking speed speculation part.

In a further preferred mode of the invention, in the generator driven by the engine, it may be provided a phase winding to output an AC signal in which a phase is reversed whenever the crankshaft rotates for a specific angle, and the cranking speed speculation part may be constructed so as to speculate the cranking speed from the rotational speed information of the crankshaft.

With the aforementioned phase winding provided in the generator, since the output frequency of the phase winding is proportional to the rotational speed of the engine, the cranking speed can be speculated from the output of the phase winding. With the cranking speed speculated from the output of the phase winding provided in the generator, what is required is just to provide a simple pulser for obtaining the rotational speed information of the engine without providing a sensor such as a ring gear sensor to obtain minute crank angle information. Thus, it will be noted that a cost cut can be obtained.

The ignition control section in the controller preferably comprises ignition prohibition means to prohibit an ignition circuit from making an ignition operation until at least one fuel injection is performed when the engine should start.

With such ignition prohibition means provided therein, since the output voltage of the generator can be prevented from falling down due to the useless ignition operation when the engine should start, the output voltage of the generator can rapidly rise at the start of the engine whereby the effective first fuel injection can be performed in an earlier stage so that the startability of the engine can be improved.

Although the injection amount of fuel from the injector is determined on the fuel pressure applied from the fuel pump to the injector and is determined on a time for which the fuel is injected from the injector (fuel injection time), it can be managed by the fuel injection time because the fuel pressure given from the fuel pump to the injector is so regulated as to be kept constant by a pressure regulator.

Thus, the injection amount decision section may be so formed as to decide the fuel injection amount itself, but may preferably be so formed as to decide it in the form of the fuel injection time (the time for which the fuel is injected from the injector).

In this manner, in the case where the injection amount decision section is so formed as to decide the fuel injection amount in the form of the fuel injection time, the injection amount decision section may be formed so as to decide the injection amount in the form of the fuel injection time on the first fuel injection at the start of the engine in accordance with the cranking speed of the engine.

BRIEF DESCRIPTION OF THE DRAWINGS

The above and other objects and features of the invention will be apparent from the detailed description of the preferred embodiments of the invention, which is described and illustrated with reference to the accompanying drawings, in which.

DETAILED DESCRIPTION OF PREFERRED EMBODIMENTS

Now, the embodiments of the invention will be illustrated and described with reference to FIGS. 1 through 5.

Figure 1:
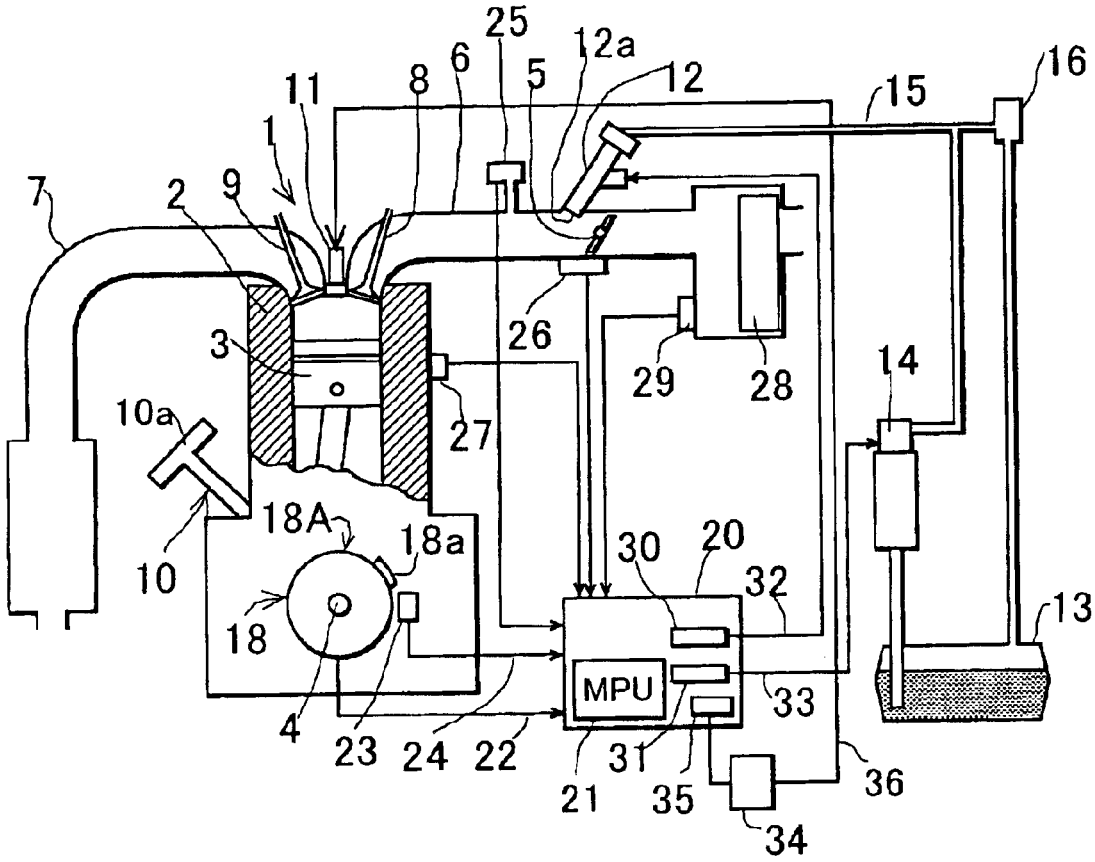
FIG. 1 is a brief schematic diagram of an example of an engine to which the invention is applied.

FIG. 1 illustrates an example of an internal combustion engine to which an electronic engine control system constructed in a first embodiment of the invention is applied. In FIG. 1, it is illustrated a single cylinder four cycle internal combustion engine 1, which has a cylinder 2, a piston 3, a crankshaft 4, an intake pipe 6 including a throttle valve 5, an exhaust pipe 7, an intake valve 8, an exhaust valve 9 and so on. The engine 1 is provided with a recoil starter 10, which serves to perform a cranking operation at a start of the engine by pulling a rope while a handle 10*a* of the starter is manually grasped.

An ignition plug 11 is provided on a head of the cylinder 2 and an injector 12 is provided having an injection port 12*a* opened at an inner space of the intake pipe 6 downstream of the throttle valve 5. Fuel within a fuel tank 13 is supplied to a fuel supply port of the injector 12 through an electric fuel pump 14. A pressure regulator 16 is provided between the fuel tank 13 and a pipe 15 connecting the fuel pump 14 and the injector 12. The pressure regulator 16 serves to keep a set value of a fuel pressure applied from the fuel pump 14 to the injector 12 by returning a portion of the fuel within the pipe 15 when the fuel pressure exceeds the set value.

A rotor 18A of a magneto generator 18 is mounted on the crankshaft 4 of the engine 1. The rotor 18A may be of such conventional type as comprises a cup-shaped flywheel mounted on the crankshaft 4 and a permanent magnet mounted on an inner periphery of the flywheel. A stator is disposed inside of the rotor 18A and forms the generator 18 together with the rotor. The stator of the generator 18 may be secured to a stator mount base provided on a crankcase of the engine.

There is provided an electronic control unit (ECU) 20 having a microprocessor 21 to which an output voltage of the generator 18 is applied through a wiring 22. In the illustrated embodiment, a reluctor 18*a* of an arc-like protrusion is provided on an outer periphery of the flywheel for the rotor of the generator 18, and there is provided a pulser 23, which detects a front edge and a rear edge of the reluctor 18*a* as viewed in a rotational direction to generate a front edge detection pulse and a rear edge detection pulse having a polarity different from each other. The output of the pulser 23 is input through a wiring 24 to the control unit 20.

In order to obtain control conditions for controlling the ignition timing and the fuel injection amount of the engine, an output of a pressure sensor 25 to detect a pressure (an intake pressure) within the intake pipe 6, an output of a throttle sensor 26 to detect an opening degree of the throttle valve 5, an output of an engine temperature sensor 27 to detect a temperature of cooling water of the engine as an engine temperature and an output of an intake air temperature sensor 29 to detect an intake air temperature near an air filter 28 connected to the intake pipe 5 are input to the ECU 20 through a predetermined wiring.

In the ECU 20, there are provided an injector drive part 30 of a hardware circuit and a fuel pump drive circuit 31. From those drive circuits, drive currents are supplied through respective wirings 32 and 33 to the injector 12 and the fuel pump 14, respectively.

In the embodiment, the injector 12, the fuel pump 14, the pressure regulator 16, the injector drive part 30 and the fuel pump drive part 31 constitute the fuel injection unit.

In the illustrated embodiment, an ignition coil 34 provided outside of the ECU 20 and an ignition circuit 35 provided in the ECU 20 constitute an ignition unit to ignite a mixture gas within a combustion chamber. The ignition circuit 35 in the ECU 20 serves to generate an igniting high voltage across a secondary coil of the ignition coil 34 by generating an abrupt variation in a primary current of the ignition coil at an ignition timing of the engine when an ignition command is given. The igniting high voltage across the secondary coil of the ignition coil 34 is adapted to be applied through a high voltage cable 36 to the ignition plug 11.

The ECU 20 forms various elements for the controller to control the ignition timing, the fuel injection timing and the fuel injection amount by practicing a predetermined programming by means of the microprocessor 21.

Figure 2:
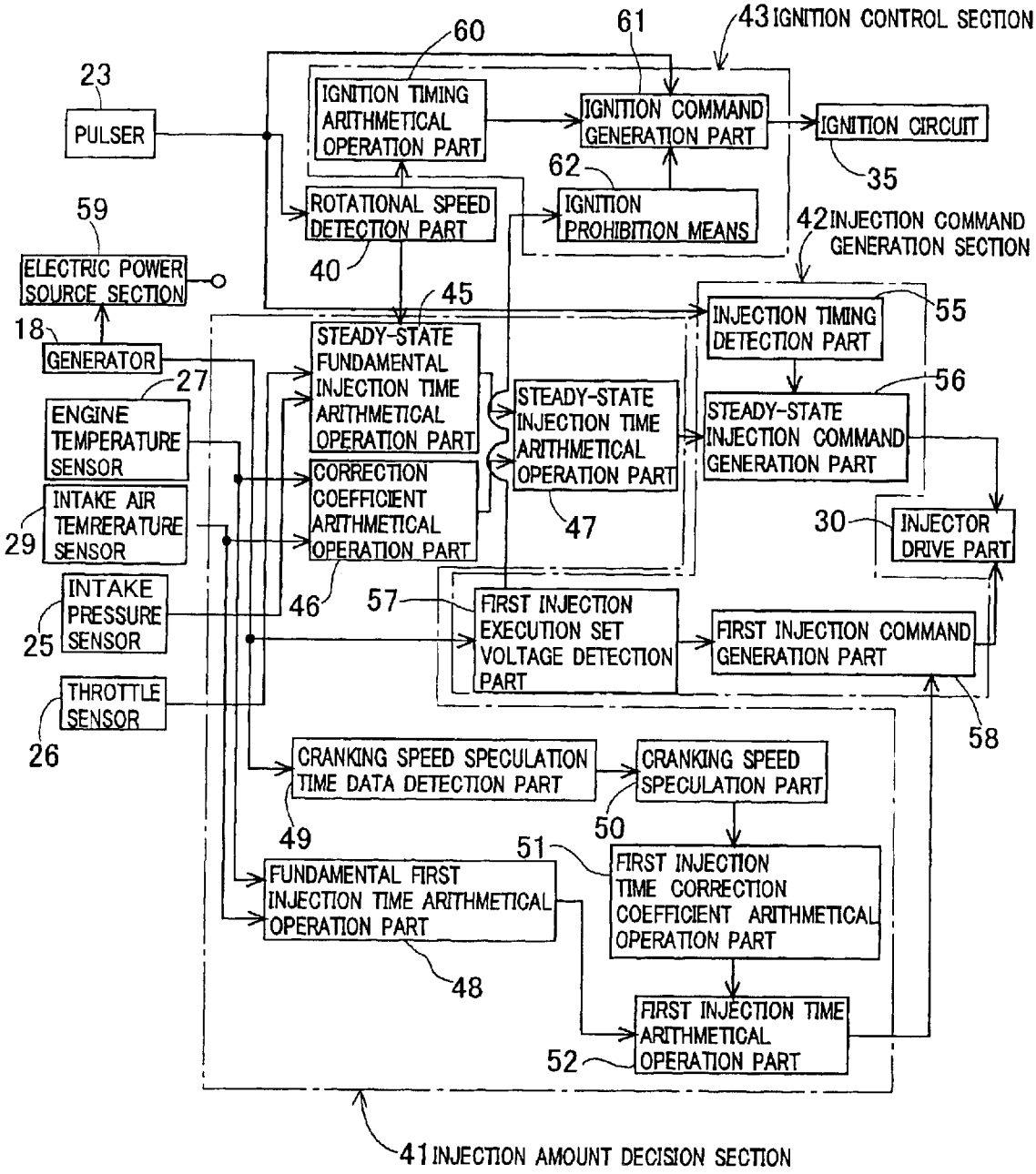
FIG. 2 is a block diagram of a controller constructed in accordance with one embodiment of the invention.

In FIG. 2, it is illustrated the controller formed by the microprocessor 21 together with the injector drive part 30 and the ignition circuit 35 provided as the hardware circuit within the ECU 20.

Roughly, the controller formed by the microprocessor 21 comprises a rotational speed detection part 40, a fuel injection control section having an injection amount decision section 41 to determine a fuel injection amount from the injector 12 and an injection command generation section 42 to generate an injection command to the injector drive part 30, and an ignition control section 43.

The rotational speed detection part 40 serves to detect the rotational speed information from a generation interval (a time required for one revolution of the crankshaft) of the pulse signals generated by the pulser 23. This rotational speed detection part 40 may comprise means to read a time measured by a timer from the generation of the previous front edge detection pulse to the generation of the present front edge detection pulse whenever the respective front edge detection pulses are generated by the pulser 23 and means to convert the time data read by the means into the rotational speed.

The illustrated injection amount decision section 41 may be formed of the following elements (1.1) through (1.8).

(1.1) Steady-state fundamental injection time arithmetical operation means 45 to speculate an intake air amount per combustion cycle of the engine from the opening degree of the throttle valve detected by the throttle sensor 26 and the rotational speed detected by the rotational speed detection part 40 to arithmetically operate a fundamental injection time necessary for obtaining an air-to-fuel ratio predetermined on the speculated intake air amount.

This steady-state fundamental injection time arithmetical operation means 45 may be so formed as to arithmetically operate the fundamental injection time on the intake air amount per combustion cycle speculated from the rotational speed of the engine and the intake pressure.

(1.2) Correction coefficient arithmetical operation part 46 to arithmetically operate correction coefficients (engine temperature correction coefficient and intake air temperature correction coefficient) to be multiplied by the fundamental injection time for arithmetically operating the actual injection time in the steady-state on the engine temperature (the cooling water temperature) detected by the engine temperature sensor 27 and the intake air temperature detected by the intake air temperature sensor 29.

(1.3) Steady-state injection time arithmetical operation part 47 to arithmetically operate the actual injection time by multiplying the fundamental injection time arithmetically operated by the fundamental injection time arithmetical operation part 45 by the correction coefficient arithmetically operated by the correction coefficient arithmetical operation part 46.

(1.4) Fundamental first injection time arithmetical operation part 48 to arithmetically operate a fundamental first injection time, which is a fundamental injection time at a first injection of the start of the engine relative to the engine temperature detected by the engine temperature sensor 27 and the intake air temperature detected by the intake air temperature sensor 29.

This arithmetical operation of the fundamental first injection time may be accomplished by searching a map for the fundamental first injection time arithmetical operation map (three-dimensional map) giving a relationship among the engine temperature, the intake air temperature and the fundamental first injection time.

(1.5) Cranking speed speculation time data detection part 49 to detect as cranking speed speculation time data a lapse time from the time when microprocessor starts to the time when the monitored output voltage of the generator 18 reaches a predetermined set value for speculation of the cranking speed.

This detection part may comprise means to read the measurement value of the timer starting at the initiation of the microprocessor when the output voltage of the generator reaches the predetermined set value for the cranking speed speculation.

(1.6) Cranking speed speculation part 50 to speculate the cranking speed of the engine from the increase ratio of the output voltage of the generator on cranking, which is determined by the time data detected by the cranking speed speculation time data detection part 49, the set value for the cranking speed speculation and the output voltage (initiation voltage) of the generator when the microprocessor starts.

(1.7) First injection time correction coefficient arithmetical operation part 51 to arithmetically operate first injection time correction coefficient to be multiplied by the fundamental first injection time for obtaining the actual injection time at the first injection on the cranking speed speculated by the cranking speed speculation part 50.

(1.8) First injection time arithmetical operation part 52 to arithmetically operate the first injection time at the start of the engine by multiplying the fundamental first injection time arithmetically operated by the fundamental first injection time arithmetical operation part 48 by the correction coefficient arithmetically operated by the first injection time correction coefficient arithmetical operation part 51.

The injection command generation section 42 may be formed of the following elements (2.1) through (2.4)

(2.1) Injection timing detection part 55 to detect as a sequential injection timing a timing at which the pulser 23 generates the front edge detection pulse.

The injection timing detection part 55 of this embodiment is so formed as not to detect as the sequential injection timing the timing at which the front edge detection pulse is generated, when the pulser 23 generates the front edge pulse before a first injection command generation section described later generates a first injection command, and when the pulser 23 generates the first front edge detection pulse after the first injection command is generated. The injection timing detection part 55 is adapted to detect the sequential injection timing since the second front edge detection pulse is generated after the first injection is made.

(2.2) Steady-state injection command generation section 56 to generate a steady-state injection command of rectangular wave pulse having a time width determined by adding a predetermined useless injection time to the injection time arithmetically operated by the steady-state injection time arithmetical operation part 47 when the injection timing detection part 55 detects the injection timing and to apply the injection command to the injector drive part 30.

(2.3) First injection execution set voltage detection part 57 to detect a timing at which the output voltage of the generator 18 reaches the predetermined set voltage for the first injection execution.

The first injection execution set voltage is so set as to be equal to the output voltage of the generator for positively opening the valve of the injector 12 (a valve openable voltage or a voltage slightly higher than the valve openable voltage).

(2.4) First injection command generation section 58 to generate a first injection command having a time width corresponding to a time obtained by adding the useless injection time to the injection time arithmetically operated by the first injection time arithmetical operation part 52 when the first injection execution set voltage detection part 57 detects that the output voltage of the generator reaches the first injection execution set voltage and to apply the first injection command to the injector drive part 30.

The ignition control section 43 may be formed of the following elements (3.1) through (3.3)

(3.1) Ignition timing arithmetical operation part 60 to arithmetically operate an ignition timing of the engine 1 on the control conditions such as the rotational speed detected by the rotational speed detection part 40.

The ignition timing is arithmetically operated in the form of time necessary for rotating the crankshaft from a fundamental crank angle position (a crank position where the pulser 23 generates the front edge detection pulse, for example) to a crank angle position corresponding to the ignition timing.

(3.2) Ignition command generation part 61 to generate an ignition command when the pulser 23 generates the rear edge detection pulse Vs2 while the rotational speed is equal to or less than the set value, to begin a measurement of the ignition timing arithmetically operated by the ignition timing arithmetical operation part 60 when the reference crank angle position is detected (when the front edge detection pulse is generated by the pulser 23 in this embodiment) while the rotational speed of the engine 1 exceeds the set value, to generate the ignition command when the measurement is completed (when the arithmetically operated ignition timing is detected), and to apply the ignition command to the ignition circuit 35.

(3.3) Ignition prohibition means 62 to prohibit the ignition unit from making the ignition operation until at least one fuel injection is performed on the start of the engine 1.

The ignition prohibition means 62 may be so constructed as to prohibit the ignition operation by prohibiting the ignition command signal from being supplied to the ignition circuit 35 until at least one fuel injection is performed on the start of the engine 1 or by making a part of the ignition circuit 35 inoperative, but it should be noted that the illustrated ignition prohibition means 62 is so constructed as to prohibit the ignition command generation part 61 from generating the ignition command signal when the pulser 23 generates the rear edge detection pulse Vs2 until the first injection command generation section 58 generates the first injection command and when the pulser 23 generates the first rear edge detection pulse Vs2 after the first injection command is generated.

In the embodiment, there is provided an electric power source section 59 to apply a driving power from the generator 18 to the ignition unit, the fuel injection unit and the controller. The electric power source section 59 comprises a rectifier circuit to rectify the output of the generator 18 and a voltage regulator to regulate the rectified output so as to be kept at a constant value. A constant DC voltage Vcc obtained from the electric power source section 59 is applied to the fuel injection unit and the ignition unit as it is. The DC voltage obtained from the electric power source section 59 is also input to a constant voltage electric power source circuit provided in the controller 20. The constant voltage electric power source circuit serves to reduce the DC voltage applied from the electric power source section 59 to a constant voltage (5V, for example) to apply it as a power source voltage to the controller (the microprocessor 21).

In the embodiment, the cranking speed speculation time data detection part 49, the cranking speed speculation part 50, the first injection time correction coefficient arithmetical operation part 51 and the first injection time arithmetical operation part 52 constitute the first injection amount decision part to decide the first fuel injection amount by correcting the previously set first fuel injection amount (the fundamental first injection amount) on the start of the engine in accordance with the cranking speed of the engine 1. In this embodiment, the fuel injection amount from the injector 12 is adapted to be arithmetically operated in the form of the fuel injection time.

Figures 3A, 3B, 3C, 3D, 3E:
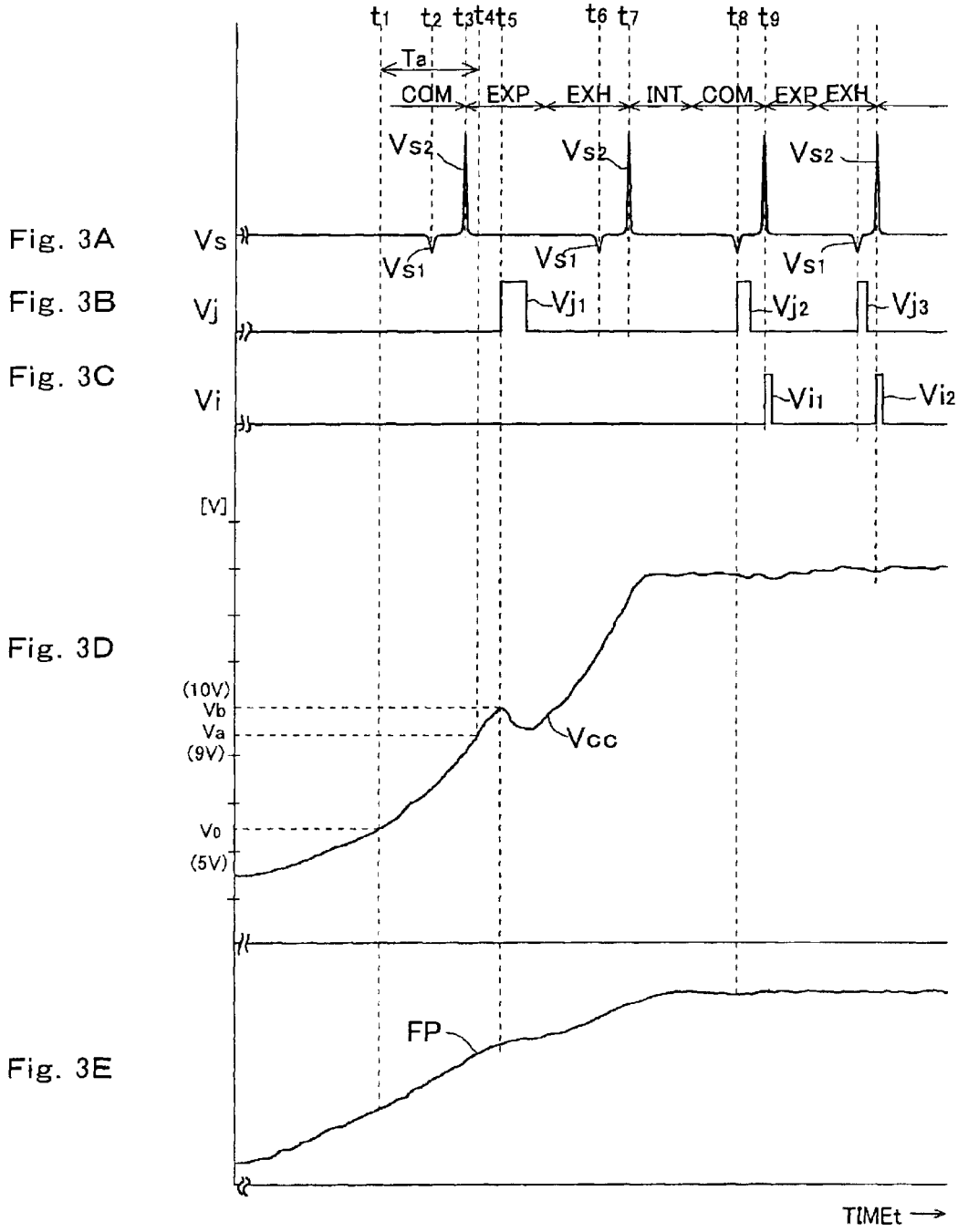
FIGS. 3A through 3E illustrate timing charts for explaining an operation of the embodiment of FIG. 2.

The operation of the embodiment illustrated in FIGS. 1 and 2 will be explained with reference to the timing chart of FIG. 3. FIG. 3A shows the front edge detection pulse Vs1 and the rear edge detection pulse Vs2 relative to time t, and FIGS. 3B and 3C show the injection command Vj and the ignition command Vi, respectively. FIG. 3D shows the output voltage Vcc of the electric power source section 59 having the generator 18 as the electric power source, and FIG. 3E shows the fuel pressure FP applied to the injector 12.

In the engine 1 illustrated in FIG. 1, as the start operation (the cranking operation) is performed by the recoil starter 10, the generator 18 generates the AC voltage. The output voltage of the generator is input to the microprocessor 21 through the voltage detection circuit provided in the ECU 20.

As the output voltage of the generator reaches the initiation voltage Vo of the microprocessor 21 at time t1 of FIG. 3, the microprocessor 21 is initiated and initialized. The initiation voltage Vo of the microprocessor 21 is 5V, for example. In this initialization process, the fundamental first injection time arithmetical operation part 48 searches the fundamental first injection time arithmetical operation map on the output of the engine temperature sensor 27 and the output of the intake air temperature sensor 29 to arithmetically operate the fundamental first injection time. The fundamental first injection time arithmetical operation map is the three-dimensional map providing a relationship between the engine temperature, the intake air temperature and the fundamental first injection time, and is stored in map storage means for the fundamental first injection time arithmetical operation (which is formed by ROM of the microprocessor 21).

The microprocessor 21 starts the timer for the cranking speed speculation time data measurement in the initialization process.

As the pulser 23 generates the front edge detection pulse Vs1 at time t2, the measurement value of the timer for detecting the rotational speed of the engine 1 is read in the microprocessor 21, but the rotational speed of the engine 1 cannot be yet detected.

The pulser 23 generates the rear edge detection pulse Vs2 indicating the ignition timing at the low speed at time t3, but since the ignition prohibition means 62 prohibits the generation of the ignition command from the ignition command generation part 61, the ignition operation is not performed.

The microprocessor 21 monitors the output voltage Vcc of the electric power source section 59 (the output voltage of the generator 18) after its initiation and reads as the cranking speed speculation time data Ta the measurement value of the cranking speed speculation time data measurement timer when the monitored voltage reaches the cranking speed speculation set voltage Va stored in the ROM at time t4. The cranking speed speculation set voltage Va is set at 9V, for example.

Thereafter, the microprocessor 21 detects the increase ratio $\gamma$ of the output voltage of the generator [$\gamma=(Va-Vo)/Ta$] from the time data Ta, the cranking speed speculation set voltage Va and the initiation voltage Vo by the cranking speed speculation part 50 in order to speculate the cranking speed of the engine 1 from the increase ratio.

Then, the first injection time correction coefficient arithmetical operation part 51 arithmetically operates the first injection time correction coefficient relative to the speculated cranking speed, and the first injection time arithmetical operation part 52 arithmetically operates the first injection time by multiplying the fundamental first injection time by the first injection time correction coefficient.

Next, the microprocessor 21 generates the injection command Vj1 from the first injection command generation section 58 when the first injection execution set voltage detection part 57 detects that the output voltage of the generator 18 reaches the first injection execution set voltage Vb at time t5 in order to apply the injection command Vj1 to the injector drive part 30.

Since the injector drive part 30 gives the injector the drive current to the injector 12 at that time, the injector injects the fuel during the arithmetically operated first injection time.

The first injection execution set voltage Vb is set at 10V, for example, in consideration of the positively opened condition of the valve of the injector 12 and the prevention of too long useless injection time.

Then, as the pulser generates the front edge detection pulse Vs1 at time t6, the time data for the rotational speed detection is obtained, and therefore the rotational speed detection part 40 detects the rotational speed. At that time, the front edge detection pulse Vs1 is applied to the injection timing detection part 55, but since the injection timing detection part 55 is so constructed as to detect the sequential injection timing since the second front edge detection pulse is generated after the first injection as aforementioned, the injection timing detection part 55 never detect time t6 as the sequential injection timing. Thus, the steady-state injection command generation section 56 never generates the injection command at time t6.

Then, the pulser 23 generates the rear edge detection pulse at time t7, but since the ignition prohibition means 62 is so constructed as to prohibit the generation of the ignition command from the ignition command generation part 61 when the pulser 23 generates the rear edge detection pulse Vs2 until the first injection command generation section 58 generates the first injection command and when the pulser 23 generates the first rear edge detection pulse Vs2 after the generation of the first injection command as aforementioned, the ignition command generation part 61 never generates the ignition command.

As the pulsar 23 generates the front end edge detection pulse Vs1 at time t8, the injection timing detection part 55 detects the sequential injection timing, and therefore the steady-state injection command generation section 56 generates the injection command Vj2. Subsequently, as the pulsar generates the rear edge detection pulse Vs2 at time t9, since the ignition command generation part 61 generates the ignition command, the ignition circuit 35 controls the primary current of the ignition coil 34, and the igniting high voltage is induced across the secondary side of the ignition coil so that the ignition operation is made. This ignites the mixture gas in the cylinder so that the engine starts.

The operation of the control system after the engine 1 starts is performed in a manner similar to that of the prior art control system.

In the aforementioned embodiment, the cranking speed is speculated from the increase rate of the output voltage of the generator 18 on the cranking operation, but if the generator has multiple poles, a generation coil of the generator is used as a phase winding which outputs the signal having a phase reversed whenever the crankshaft of the engine 1 rotates for a predetermined angle. The cranking speed speculation part 50 may be so constructed as to speculate the cranking speed from the rotational speed information included in the output of the phase winding.

The cranking speed can be speculated from the number of phase reversion of the output of the phase winding and the time required for the phase reversion, for example. Otherwise, the cranking speed can be speculated from the time from the respective zero cross points of the output of the phase winding to the next zero cross point or the time from the respective peaks to the next peak.

Figure 4:
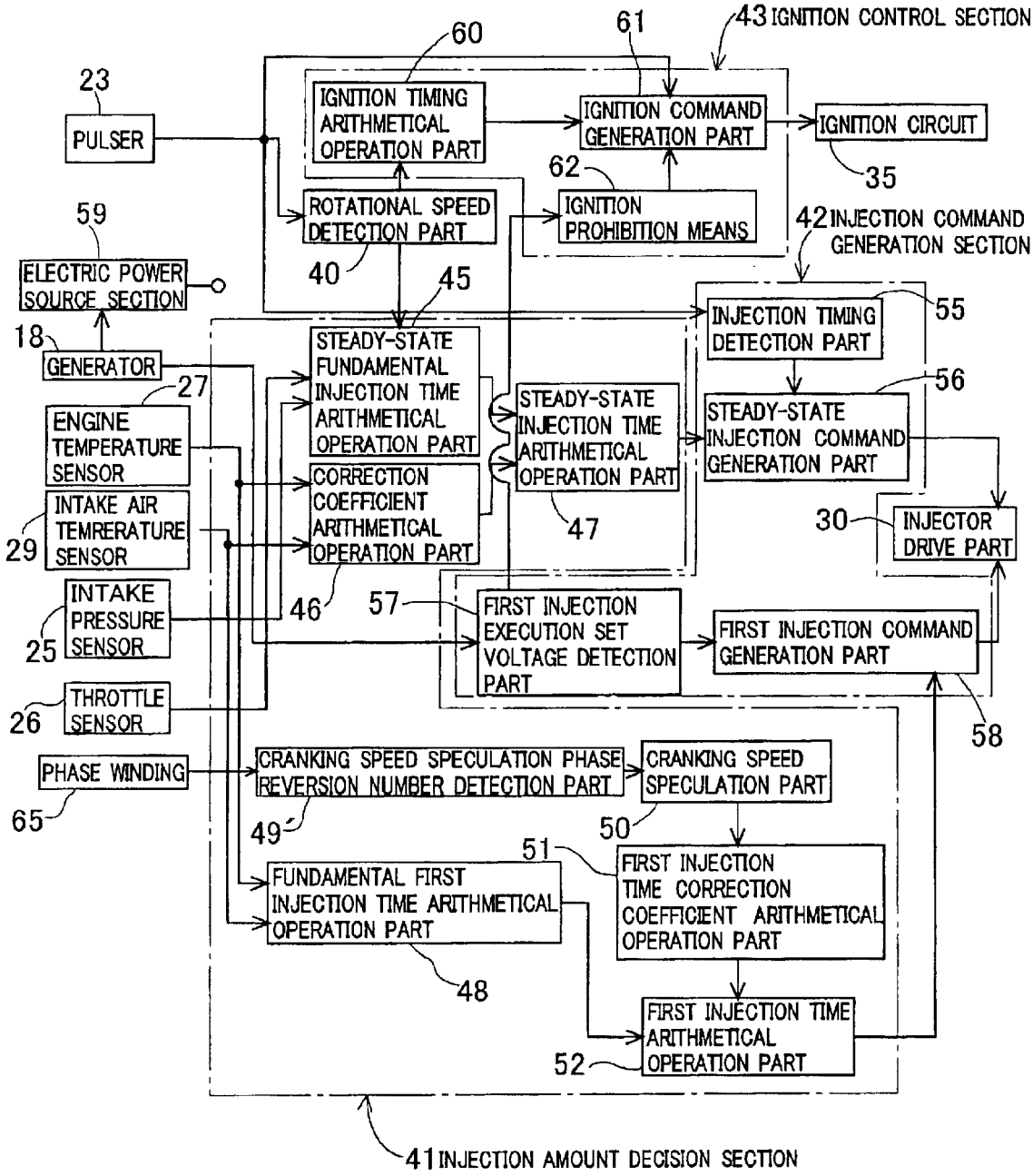
FIG. 4 is a block diagram of a controller constructed in accordance with another embodiment of the invention.

A construction of the control system in which the aforementioned detection of the cranking speed is performed is illustrated in FIG. 4. In the embodiment of FIG. 4, the cranking speed speculation time data detection part 49 of FIG. 2 is replaced by the cranking speed speculation phase reversion number detection part 49' to detect the number of phase (pole) reversion of the output of the phase winding 65.

Figures 5A, 5B, 5C, 5D, 5E:
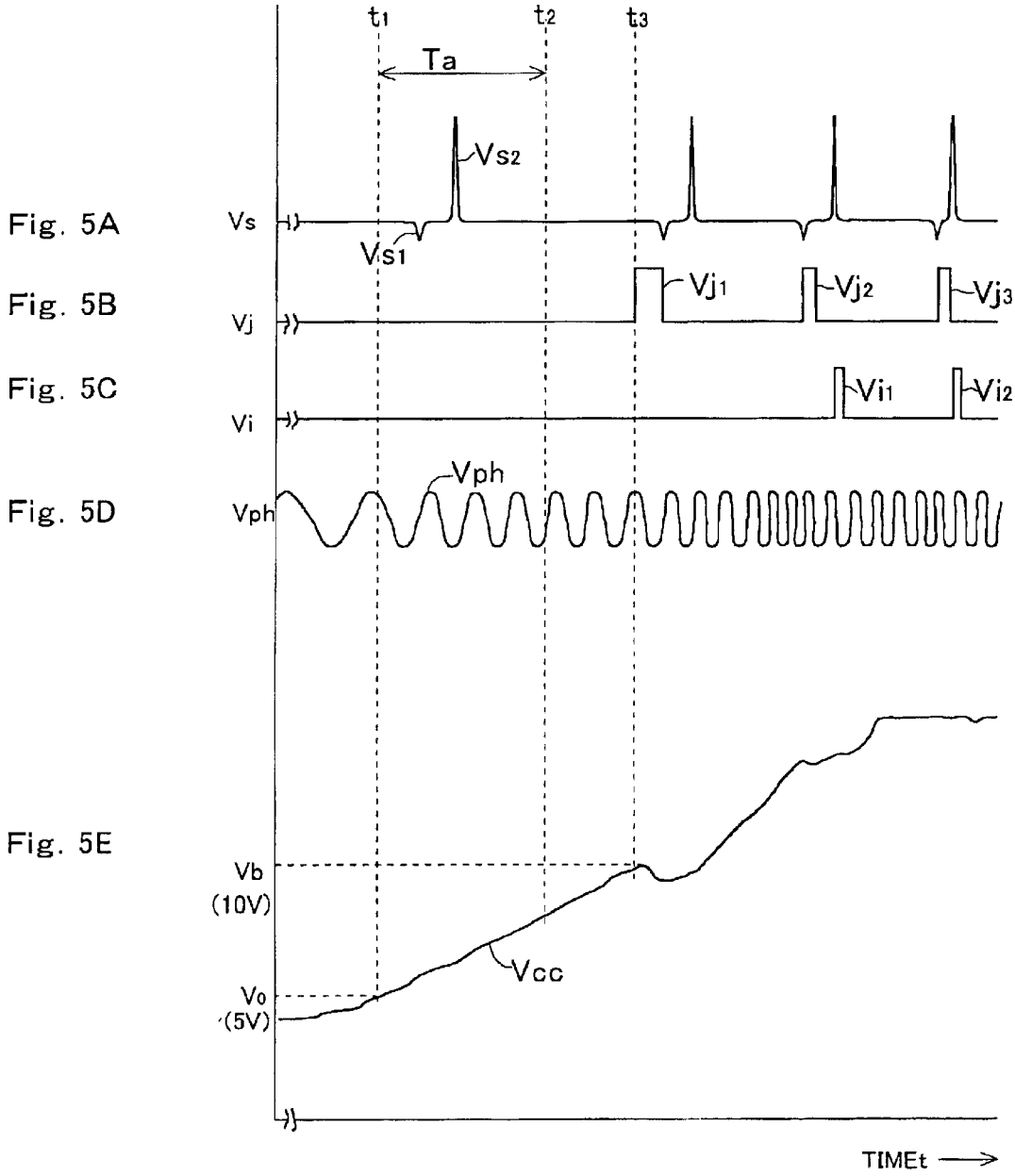
FIGS. 5A through 5E illustrate timing charts for explaining an operation of the embodiment of FIG. 4.
Figures 6A, 6B, 6C, 6D, 6E:
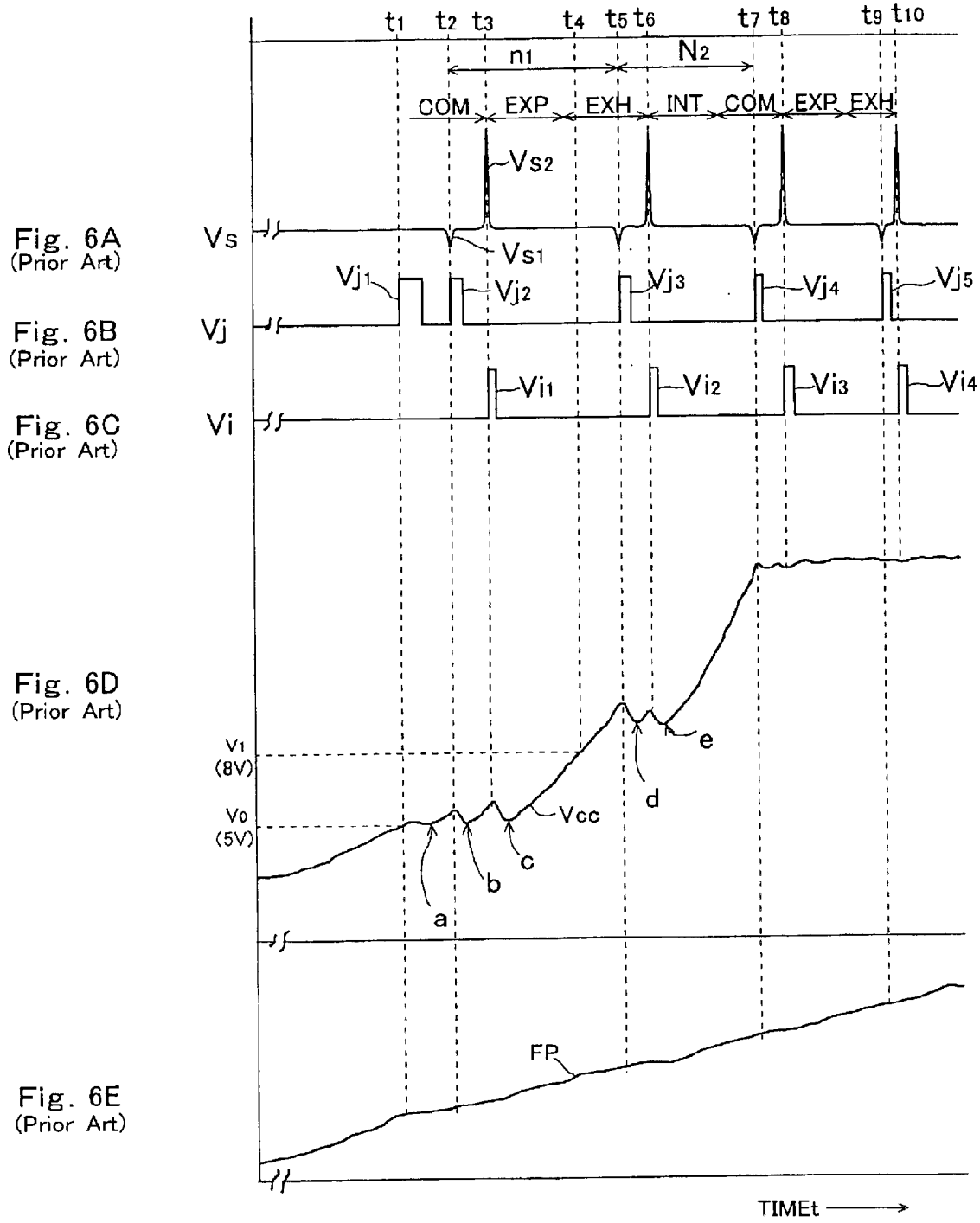
Fig. 6A (Prior Art)
Fig. 6B (Prior Art)
Fig. 6C (Prior Art)
Fig. 6D (Prior Art)
Fig. 6E (Prior Art)
FIGS. 6A through 6E illustrate timing charts for explaining an operation of the prior art electronic engine control system.

In the embodiment of FIG. 4, the rotor of the generator 18 has 12 poles, and a single phase generation coil wound with the relatively few number of turns on the stator side is used as the phase winding 65. Since the rotor has 12 poles, the phase winding 65 generates an AC output voltage Vph of 6 cycles during one revolution of the crankshaft of the engine as shown in FIG. 5D. More particularly, the output voltage Vph of the phase winding 65 is the AC voltage having the phase reversed every 30-degree rotation of the crankshaft (the polarity is reversed from the positive half wave to the negative half wave or from the negative half wave to the positive half wave).

The output voltage of the phase winding 65 is converted into a rectangle wave signal by a waveform modification circuit provided in the ECU 20 and is input into the microprocessor 21. The microprocessor 21 recognizes that the rising edge of the rectangular wave signal output by the waveform modification circuit (a zero cross point at the time of the output voltage of the phase winding shifting to the positive half-wave from the negative half-wave) and the falling edge thereof (a zero cross point at the time of the output voltage of the phase winding shifting to the negative half-wave from the positive half-wave) are timings at which the phase of the output of phase winding reverses, respectively.

The microprocessor 21 starts the counting operation of the timer in the initialization process on the initiation of the microprocessor when the output voltage Vcc (see FIG. 5E) of the electric power source section (the output voltage of the generator) reaches the initiation voltage Vo at time t1, and also starts the counting operation of the number of phase reversion of the output of the phase winding by the cranking speed speculation phase reversion number detection part 49'. The counting operation of the number of phase reversion can be made by performing the interruption process whenever the timing at which the phase of the output of the phase winding is reversed is detected to carry out an increment of the total count value, for example.

The cranking speed speculation part 50 reads the count value of the timer as the cranking speed speculation time data Ta when the number of phase reversion measured by the cranking speed speculation phase reversion number detection part 49' reaches the set value (8 times, in the illustrated embodiment) at time t2 in FIG. 5 and speculates the cranking speed from the cranking speed speculation time data Ta and the set value of the number of phase reversion.

When the first injection execution set voltage detection part 57 detects at time t3 that the output voltage Vcc of the electric power source section reaches the first injection execution voltage Vb (10V, in the illustrated embodiment), the first injection command generation section 58 generates the first injection command Vj1 to perform the first injection.

In the illustrated embodiment, the set value of the number of phase reversion is set at 8 times considering that the enough evaporation time of the fuel is obtained and that the output voltage of the generator should be prevented from exceeding the first injection execution set voltage. Also, the first injection execution set voltage Vb is set at 10V considering that the valve of the injector is positively opened, that the useless injection time should not be too long and that the fuel pressure is rising to some extent.

The other construction and the operation of the control system of FIG. 4 are similar to those of the embodiment of FIG. 2.

As shown in the respective embodiments, with the injection amount of the first fuel injection on the start of the engine corrected in accordance with the cranking speed of the engine, the variation in the intake air amount due to individual difference of the operative force on the start of the engine can hardly take an effect on the air-to-fuel ratio, which improves the startability of the engine.

As aforementioned, with the first injection command on the start operation of the engine generated when the output voltage of the generator reaches the set value (when the output voltage Vcc of the electric power source section reaches the voltage Vb), the fuel of amount corrected so that an influence of the difference of the intake air amount produced due to the difference of the cranking speed becomes lesser can be injected at the shortest timing after the start operation begins by determining the set value so as to be equal to the valve openable voltage or the voltage slightly higher than the valve openable voltage. Thus, the time from the first fuel injection to the effective first ignition operation can be longer by performing the first effective injection at an earlier timing after the start operation of the engine begins. Accordingly, the fuel injected until the first ignition is performed can be fully evaporated to enable the air-to-fuel ratio of the mixture gas to get the proper value and therefore improves the startability of the engine.

With the ignition unit prohibited from making the ignition operation until the at least one fuel injection is performed on the start of the engine as aforementioned, since the output voltage of the generator can be prevented from falling down due to the useless ignition operation on the start of the engine, the output voltage of the generator on the start of the engine can rise in an earlier manner, and the effective first fuel injection can be made as soon as possible, which improves the startablity of the engine.

In the illustrated embodiment, in addition to the start injection time correction coefficient arithmetical operation part to arithmetically operate the correction coefficient for correcting the first injection time on the start of the engine in accordance with the cranking speed and the first injection command generation part to generate the first injection command when the output voltage of the generator reaches the set value, it is provided the ignition prohibition means to prohibit the ignition operation of the ignition unit until at least one fuel injection is made on the start of the engine. But, also in the case of providing the injection command generation section to generate the first injection command when the output voltage of the generator reaches the set value without correcting the first injection time on the start of the engine, the aforementioned ignition prohibition means may be provided so that the output voltage of the generator can be prevented from falling down on the start of the engine, the output voltage of the generator on the start of the engine can rise in an earlier manner and the effective first fuel injection can be made as soon as possible, which advantageously improves the startablity of the engine.

Although the ignition prohibition means may be preferably provided in view of the improvement of the startability, it may be omitted if there is little fall-down of the output voltage of the generator.

Although the invention is applied to the single cylinder four cycle internal combustion engine, it may be applied to a multiple cylinder four cycle engine.

Although some preferred embodiments of the invention have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. An electronic engine control system comprising a controller having an ignition control section to control an ignition of an internal combustion engine and a fuel injection control section to control an injector of a fuel injection unit to supply fuel to said engine, and an electric power source section to supply a driving power from a generator driven by said engine to said fuel injection unit and said controller; said fuel injection control section comprising an injection amount decision section to decide a fuel injection amount, an injection command generation section to generate an injection command and an injector drive part to drive said injector in response to said injection command to inject said fuel from said injector; said injection command generation section being so constructed as to generate a first injection command when an output voltage of said generator reaches a set value after the start operation of the engine begins; and said set value being set at a value capable of opening a valve of said injector positively.

2. An electronic engine control system comprising a controller having an ignition control section to control an ignition of an internal combustion engine and a fuel injection control section to control an injector of a fuel injection unit to supply fuel to said engine, and an electric power source section to supply a driving power from a generator driven by said engine to said fuel injection unit and said controller; said fuel injection control section comprising an injection amount decision section to decide a fuel injection amount, an injection command generation section to generate an injection command and an injector drive part to drive said injector in response to said injection command to inject said fuel from said injector; said injection amount decision section comprising a first injection amount decision part to decide a first injection amount on the start of said engine in accordance with a cranking speed of said engine; and said injection command generation section being so constructed as to generate a first injection command when an output voltage of said generator reaches a set value after the start operation of the engine begins; and said set value being set at a value capable of opening a valve of said injector positively.

3. An electronic engine control system as set forth in claim 2 and wherein said first injection amount decision part decides said first fuel injection amount by correcting said predetermined first fuel injection amount on the start of said engine in accordance with said cranking speed of said engine.

4. An electronic engine control system as set forth in claim 2 and wherein said injection amount decision section further comprises a cranking speed speculation part to speculate said cranking speed from an increase rate of said output voltage of said generator, said first injection amount decision part being so constructed as to decide said first fuel injection amount using said cranking speed speculated by said cranking speed speculation part.

5. An electronic engine control system as set forth in claim 2 and wherein said generator has a phase winding to output an AC signal having a phase reversed every rotation of a crankshaft of said engine for a predetermined angle and wherein said injection amount decision section further comprises a cranking speed speculation part to speculate said cranking speed from a rotational speed information of said crankshaft included in an output signal of said engine, said first injection amount decision part being so constructed as to decide said first fuel injection amount using said cranking speed speculated by said cranking speed speculation part.

6. An electronic engine control system as set forth in claim 2 and wherein said ignition control section comprises ignition prohibition means to prohibit an ignition of said engine until at least one fuel injection is made on the start of said engine.

7. An electronic engine control system comprising a controller having an ignition control section to control an ignition of an internal combustion engine and a fuel injection control section to control an injector of a fuel injection unit to supply fuel to said engine, and an electric power source section to supply a driving power from a generator driven by said engine to said fuel injection unit and said controller; said fuel injection control section comprising an injection amount decision section to decide a fuel injection amount injected from said injector, an injection command generation section to generate an injection command and an injector drive part to drive said injector in response to said injection command to inject said fuel from said injector, said injector amount decision section comprising a first injection amount decision part to decide a first injection amount in the form of a fuel injection time on the start of said engine in accordance with a cranking speed of said engine, and said injection command generation section being so constructed as to generate a first injection command when an output voltage of said generator reaches a set value after a cranking operation of said engine begins; and said set value being set at a value capable of opening a valve of said injector positively.

8. An electronic engine control system as set forth in claim 7 and wherein said first injection amount decision part decides said fuel injection time for applying said first fuel injection amount by correcting a predetermined first fuel injection time on the start of said engine in accordance with said cranking speed of said engine.

9. An electronic engine control system as set forth in claim 7 and wherein said injection amount decision section further comprises a cranking speed speculation part to speculate said cranking speed from an increase rate of said output voltage of said generator, and said first injection amount decision part being so constructed as to decide said first fuel injection time using said cranking speed speculated by said cranking speed speculation part.

10. An electronic engine control system as set forth in claim 7 and wherein said generator has a phase winding to output an AC signal having a phase reversed every rotation of a crankshaft of said engine for a predetermined angle and wherein said injection amount decision section further comprises a cranking speed speculation part to speculate said cranking speed from a rotational speed information of said crankshaft included in an output signal of said engine and said first injection amount decision part being so constructed as to decide said first fuel injection time using said cranking speed speculated by said cranking speed speculation part.

11. An electronic engine control system as set forth in claim 7 and wherein said ignition control section comprises ignition prohibition means to prohibit an ignition of said engine until at least one fuel injection is made on the start of said engine.

12. An electronic engine control system comprising a controller having an ignition control section to control an ignition of an internal combustion engine and a fuel injection control section to control an injector of a fuel injection unit to supply fuel to said engine, and an electric power source section to supply a driving power from a generator driven by said engine to said fuel injection unit and said controller; said fuel injection control section comprising an injection amount decision section to decide a fuel injection amount, an injection command generation section to generate an injection command and an injector drive part to drive said injector in response to said injection command to inject said fuel from said injector; said injection amount decision section comprising a first injection amount decision part to decide a first injection amount on the start of said engine in accordance with a cranking speed of said engine; and said injection command generation section being so constructed as to generate a first injection command when an output voltage of said generator reaches a set value after the start operation of the engine begins; said ignition control section comprises ignition prohibition means to prohibit an ignition of said engine until at least on fuel injection is made on the start of said engine.

13. An electronic engine control system comprising a controller having an ignition control section to control an ignition of an internal combustion engine and a fuel injection control section to control an injector of a fuel injection unit to supply fuel to said engine, and an electric power source section to supply a driving power from a generator driven by said engine to said fuel injection unit and said controller; said fuel injection control section comprising an injection amount decision section to decide a fuel injection amount injected from said injector, an injection command generation section to generate an injection command and an injector drive part to drive said injector in response to said injection command to inject said fuel from said injector, said injector amount decision section comprising a first injection amount decision part to decide a first injection amount in the form of a fuel injection time on the start of said engine in accordance with a cranking speed of said engine, and said injection command generation section being so constructed as to generate a first injection command when an output voltage of said generator reaches a set value after a cranking operation of said engine begins; said ignition control section comprises ignition prohibition means to prohibit an ignition of said engine until at least one fuel injection is made on the start of said engine.

* * * * *